US012687015B2

(12) United States Patent
Zhou et al.

(10) Patent No.: US 12,687,015 B2
(45) Date of Patent: Jul. 21, 2026

(54) FAST BUILT ASSEMBLED WALL

(71) Applicant: A&C Future, Inc, Newport Beach, CA (US)

(72) Inventors: Zhuangboyu Zhou, Newport Beach, CA (US); Jiuqi Wang, Tustin, CA (US); Keguan Zou, Irvine, CA (US); Han Qin, Newport Beach, CA (US); Sichen Li, Irvine, CA (US); Jiayang Qin, Newport Beach, CA (US)

( * ) Notice: Subject to any disclaimer, the term of this patent is extended or adjusted under 35 U.S.C. 154(b) by 808 days.

(21) Appl. No.: 17/813,537

(22) Filed: Jul. 19, 2022

(65) Prior Publication Data

US 2024/0026679 A1 Jan. 25, 2024

(51) Int. Cl.

| | |
|---|---|
| ***E04B 2/36*** | (2006.01) |
| ***E04B 2/00*** | (2006.01) |
| ***E04B 2/74*** | (2006.01) |
| *E04B 2/40* | (2006.01) |

(52) U.S. Cl.

CPC ..... *E04B 2/7425* (2013.01); *E04C 2/46* (2013.01); *E04B 2/40* (2013.01); *E04B 2/7407* (2013.01); *E04B 2/7431* (2013.01); *E04B 2/7442* (2013.01); *E04B 2002/7462* (2013.01)

(58) Field of Classification Search

None

See application file for complete search history.

(56) References Cited

U.S. PATENT DOCUMENTS

| | | | | |
|---|---|---|---|---|
| 2,163,454 | A * | 6/1939 | Slick | E04C 1/42 52/308 |
| 4,535,577 | A | 8/1985 | Tenser | |
| 6,389,773 | B1 | 5/2002 | Reuter | |
| 7,823,351 | B2 | 11/2010 | Tiberi | |
| 8,844,222 | B2 | 9/2014 | Glick | |
| 10,435,885 | B2 * | 10/2019 | Piethman | E04B 1/14 |
| 11,225,791 | B2 | 1/2022 | Gosling | |
| 11,781,315 | B1 * | 10/2023 | Zhou | E04B 1/02 52/238.1 |

(Continued)

FOREIGN PATENT DOCUMENTS

| | | | | |
|---|---|---|---|---|
| CN | 107178173 | A * | 9/2017 | C09K 5/063 |
| CN | 107938934 | A * | 4/2018 | E04C 2/284 |

(Continued)

*Primary Examiner* — Phi D A

(74) *Attorney, Agent, or Firm* — CIONCA IP Law P.C.

(57) ABSTRACT

A modular wall having a frame having a plurality of frame sections; a frame fastener configured to interconnect the plurality of frame sections to form a plurality of mortises between each pair of adjacent frame sections; and a plurality of cover panels, each cover panel having at least one tenon configured to snuggly engage with a corresponding mortise to selectively secure the cover panel to the frame, wherein the frame is configured to engage with a support mount and a base skirt in order to secure the modular wall. The frame fastener may utilize a plurality of hinges configured to allow the frame to be collapsed into an accordion style stack to allow the wall to transported easily and rapidly assembled or disassembled. Each tenon may be filled with an insulative material such that the modular wall may provide both sound and heat insulation between its two surfaces.

8 Claims, 10 Drawing Sheets

(56) References Cited

U.S. PATENT DOCUMENTS

2019/0040630 A1* 2/2019 Piethman ..... E04B 2/7425

FOREIGN PATENT DOCUMENTS

| | | | | | |
|---|---|---|---|---|---|
| CN | 110042954 | A | * | 7/2019 | ..... E04B 2/7407 |
| CN | 116145889 | A | * | 5/2023 | |
| CN | 116971530 | A | * | 10/2023 | |
| CN | 117846178 | A | * | 4/2024 | |
| CN | 118087782 | A | * | 5/2024 | |
| CN | 119083622 | A | * | 12/2024 | |
| KR | 20150003817 | U | * | 10/2015 | |
| KR | 20170055586 | A | * | 5/2017 | |
| KR | 20220112916 | A | * | 8/2022 | |
| WO | WO-2022013389 | A1 | * | 1/2022 | ..... A47B 47/047 |
| WO | WO-2022139805 | A1 | * | 6/2022 | |

* cited by examiner

FAST BUILT ASSEMBLED WALL

BACKGROUND OF INVENTION

1. Field of the Invention

The invention relates generally to walls and specifically to walls configured to be assembled and disassembled quickly, said walls having heat and sound insulating properties.

2. Description of the Related Art

In the construction industry, there are many different methods to provide a wall, partition or divider within a room, building or other structure to divide a larger area into smaller rooms or sections. One of the most common ways to provide a traditional wall within a structure is construct it from raw materials, similar to those of the surrounding structure, such as bricks, wooden studs or other common raw building materials. Using these traditional methods does create a wall capable of dividing a larger area, but requires a significant amount of time and labor to do so. One alternative to conventional walls is to use preconstructed modular elements to build a wall from prefabricated parts. Such prefabricated components provide a more rapid solution to providing room divisions/partitions but are held back by several shortcomings. Unlike traditional walls, known wall solutions made of prefabricated parts lack a suitable mechanism for providing suitable sound and heat insulation, and thus are incapable of providing as comfortable a living experience as traditionally constructed walls. Additionally prefabricated walls still may require a moderate amount of assembly despite being made of prefabricated parts, which still may cost a significant amount of time and labor. Furthermore, unlike traditional walls, the prefabricated wall may have a design aesthetic that noticeably clashes with that of the surrounding structure, resulting in the prefabricated wall having crude, thrown together appearance.

Therefore, there is a need to solve the problems described above by proving a device and method for providing a fast build assembled wall that is configured to be assembled and disassembled rapidly while providing the insulative and aesthetic capabilities of a traditional wall.

The aspects or the problems and the associated solutions presented in this section could be or could have been pursued; they are not necessarily approaches that have been previously conceived or pursued. Therefore, unless otherwise indicated, it should not be assumed that any of the approaches presented in this section qualify as prior art merely by virtue of their presence in this section of the application.

BRIEF INVENTION SUMMARY

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

In an aspect, a modular wall is provided, the modular wall comprising: a frame having: a plurality of frame sections comprising: an upper end frame section; a lower end frame section; and a plurality of center frame sections disposed between the upper end frame section and the lower end frame section; a frame fastener configured to interconnect the plurality of center frame sections and connect the plurality of center frame sections to the upper end frame section and the lower end frame section; wherein a plurality of mortises is formed between adjacent frame sections; a plurality of cover panels, each cover panel having: at least one tenon configured to engage with a corresponding mortise of the plurality of mortises, thus securing the cover panel to the frame and further securing adjacent frame sections together; a support mount configured to engage with the upper end frame section; and a base skirt configured to engage with the lower end frame section. Thus, an advantage is that the modular wall may be assembled rapidly due to being made from a limited variety of prefabricated modular parts. Another advantage is that the height of the wall may be customized by simply varying the amount of center frame sections used in the frame and using a complementary frame fastener and corresponding quantity of cover panels to cover said frame. Another advantage is that each center frame section may be the same part, and each end frame section may be the same part resulting in the frame being comprised from two unique frame sections, simplifying both manufacturing of the parts and wall assembly. Another advantage is that the disclosed wall may be easily transported while being partially preassembled, allowing the wall to be quickly and easily assembled in fewer steps. Another advantage is that the wall may utilize specialized cover panels having embedded insulative materials to engage with the frame, allowing for the wall to provide an insulative barrier within a structure while maintaining a desired design aesthetic. Another advantage is that the snug engagement of each tenon with a corresponding mortise may further secure adjacent frame sections together. Another advantage is that the modular wall may also be disassembled quickly and easily allowing to wall to be moved or stored quickly.

In another aspect, a modular wall is provided, the modular wall comprising: a frame having: a plurality of frame sections comprising: an upper end frame section having a plurality of upper mortise sections; a lower end frame section having a plurality of lower mortise sections; and a plurality of center frame sections disposed between the upper end frame section and the lower end frame section, each center frame section having a plurality of upper mortise sections and a plurality of lower mortise sections; a frame fastener configured to interconnect each frame section, such that a plurality of upper mortise sections from a first frame section of a pair of adjacent frame sections is configured to align with a plurality of lower mortise sections from a second frame section of the pair of adjacent frame sections to form a plurality of mortises between the first frame section and the second frame section; and a plurality of cover panels, each cover panel having: at least one tenon configured to snuggly engage with a corresponding mortise of the plurality of mortises, thus securing the cover panel to the frame, each tenon having a wide upper portion, a wide lower portion and a narrow middle portion disposed between and associated with the wide lower portion and wide upper portion, wherein each mortise has a shape complementary to that of the tenon, wherein upon engagement of a tenon with the corresponding mortise, the corresponding frame sections are further secured together. Again, an advantage is that the modular wall may be assembled rapidly due to being made from a limited variety of prefabricated modular parts. Another advantage is that the height of the wall may be customized by simply varying the amount of center frame sections used in the frame and using a complementary frame fastener and corresponding quantity of cover panels to cover said frame. Another advantage is that each center frame section may be the same part, and each end frame section may be the same part resulting in the frame being comprised from two unique frame sections, simplifying both manufacturing of the parts and wall assembly. Another advantage is that the disclosed wall may be easily transported while being partially preassembled, allowing the wall to be quickly and easily assembled in fewer steps. Another advantage is that the wall may utilize specialized cover panels having embedded insulative materials to engage with the frame, allowing for the wall to provide an insulative barrier within a structure while maintaining a desired design aesthetic. Another advantage is that the snug engagement of each tenon with a corresponding mortise may further secure adjacent frame sections together. Another advantage is that the modular wall may also be disassembled quickly and easily allowing to wall to be moved or stored quickly.

In another aspect, a modular wall is provided, the modular wall comprising: a frame having a plurality of frame sections; a frame fastener configured to interconnect the plurality of frame sections to form a plurality of mortises between adjacent frame sections of the plurality of frame sections; and a plurality of cover panels, each cover panel having at least one double trapezoid shaped tenon configured to snuggly engage with a corresponding mortise of the plurality of mortises to selectively secure the cover panel to the frame; wherein the frame is configured to engage with a support mount and a base skirt in order to secure the modular wall. Again, an advantage is that the modular wall may be assembled rapidly due to being made from a limited variety of prefabricated modular parts. Another advantage is that the height of the wall may be customized by simply varying an amount of center frame sections used in the frame and using a complementary frame fastener and corresponding quantity of cover panels to cover said frame. Another advantage the frame may be comprised of identical center frame sections and identical end frame sections, resulting in the frame being comprised of two unique frame sections, simplifying both manufacturing of the parts and wall assembly. Another advantage is that the disclosed wall may be easily transported while being partially preassembled, allowing the wall to be quickly and easily assembled in fewer steps. Another advantage is that the wall may utilize specialized cover panels having embedded insulative materials to engage with the frame, allowing for the wall to provide an insulative barrier within a structure while maintaining a desired design aesthetic. Another advantage is that the snug engagement of each tenon with a corresponding mortise may further secure adjacent frame sections together. Another advantage is that the modular wall may also be disassembled quickly and easily allowing to wall to be moved or stored quickly.

The above aspects or examples and advantages, as well as other aspects or examples and advantages, will become apparent from the ensuing description and accompanying drawings.

BRIEF DESCRIPTION OF THE DRAWINGS

For exemplification purposes, and not for limitation purposes, aspects, embodiments or examples of the invention are illustrated in the figures of the accompanying drawings, in which.

DETAILED DESCRIPTION

Figure 1:
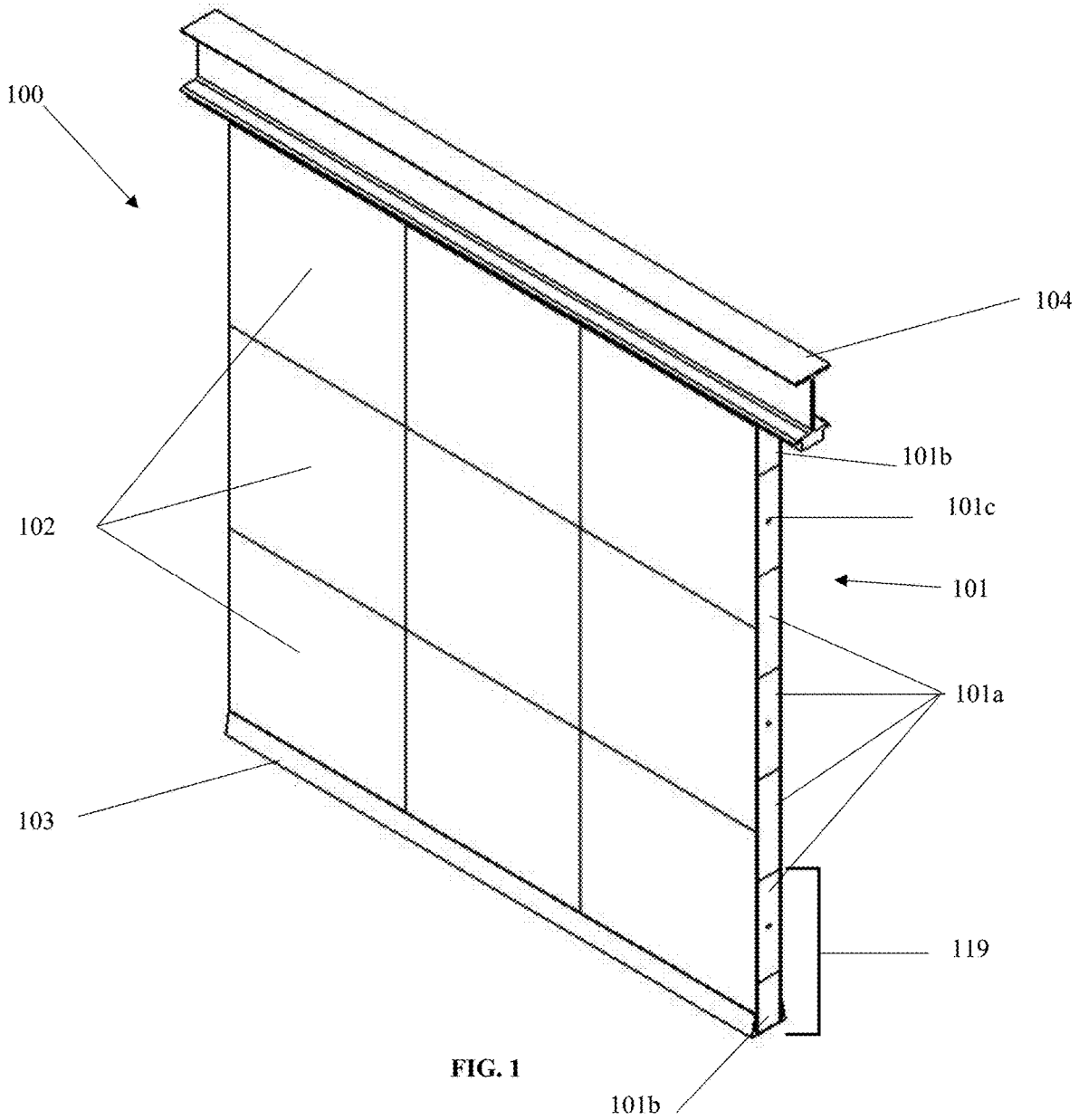
FIG. 1 illustrates the top perspective view of a fast built assembled wall, according to an aspect.

What follows is a description of various aspects, embodiments and/or examples in which the invention may be practiced. Reference will be made to the attached drawings, and the information included in the drawings is part of this detailed description. The aspects, embodiments and/or examples described herein are presented for exemplification purposes, and not for limitation purposes. It should be understood that structural and/or logical modifications could be made by someone of ordinary skills in the art without departing from the scope of the invention. Therefore, the scope of the invention is defined by the accompanying claims and their equivalents.

It should be understood that, for clarity of the drawings and of the specification, some or all details about some structural components or steps that are known in the art are not shown or described if they are not necessary for the invention to be understood by one of ordinary skills in the art.

For the following description, it can be assumed that most correspondingly labeled elements across the figures (e.g., 102 and 202, etc.) possess the same characteristics and are subject to the same structure and function. If there is a difference between correspondingly labeled elements that is not pointed out, and this difference results in a non-corresponding structure or function of an element for a particular embodiment, example or aspect, then the conflicting description given for that particular embodiment, example or aspect shall govern.

FIG. 1 illustrates the top perspective view of a fast built assembled wall 100, according to an aspect. The fast built assembled wall ("rapid assembly modular wall", "modular wall", "wall") 100 may provide a rapidly buildable wall solution for creating a partition or division within a room or other structure. The fast build wall 100 may be comprised of two main components: a wall frame 101 and a plurality of cover panels 102. The wall frame ("frame") 101 may be comprised of a plurality of frame sections 101*a*, 101*b*, wherein said plurality of frame sections may be comprised of a plurality of center frame sections 101*a* secured between two end frame section ("terminal frame sections") 101*b*. Each center frame section 101*a* and end frame section 101*b*, may be aligned along a plane, such that the resultant frame 101 is a roughly flat surface, as seen by frame 201 in FIG. 2. Upon the formation of the frame 101, a plurality of mortises, such as mortise 208 of FIG. 2A, may be formed within the frame 101 between each adjacent frame section 119. Each of the mortises may be configured to securely house a tenon on a corresponding cover panel, such as tenon 209 on cover panel 202 in FIG. 2A. Upon engagement of each tenon of the cover panels 102 with a corresponding formed mortise within the frame 101, the cover panels 102 may be secured to the frame 101, thus forming the fast build wall.

It should be understood that the term "adjacent frame sections" 119 may refer to any two frame sections which are disposed next to each other. For example, a pair of adjacent frame sections 119 may include the end frame section 101*b* disposed that the bottom of the frame 101, and the center frame section disposed immediately above it. Mortises configured to firmly/snuggly engage with the tenons on each cover panel may be formed between each pair of adjacent frame sections 119, as will be discussed in greater detail hereinbelow. Any two frame sections 101*a*, 101*b* that are in direct contact or proximity to each other, such that a plurality of mortises is formed between them may thusly be described as adjacent frame sections 119.

Certain frame sections 101*a*, 101*b* may be configured to allow wires, cables or other comparable structures to travel through them in order to facilitate their bypassing of the fast built assembled wall 100. As such, said frame sections 101*a*, 101*b* may be further comprised of a bypass hole 101*c* configured to travel laterally though the length of the corresponding frame section 101*a*, 101*b* as seen in FIG. 1. By providing such a bypass hole 101*c*, wires/cables may be discretely travel through the wall 101, without influencing its outward design aesthetic. While bypass holes 101*c* are only shown within certain frame section of the currently disclosed embodiment, it is also possible to include bypass holes 101*c* in every frame section, as will be disclosed hereinbelow.

The fast built assembled wall 100 may be further comprised of a support beam ("support mount", "support", "beam") 104 and a base skirt 103. This fast built wall 100 may be held in place by the support 104 configured to attach to a top portion of the fast built wall 100, such as an end frame section 101*b* disposed at a top end of the frame 101, and the base skirt 103 configured to engage with a bottom portion of the fast built wall 100, such as an end frame section 101*b* disposed at a bottom end of the frame 101. The support 104 and base skirt 103 may help to keep the fast built wall in place during use, while also helping maintain the stability of the frame 101. Various aspects and embodiments of the disclosed fast built assembled wall 100 will be discussed in greater detail hereinbelow.

Each of the elements of the disclosed fast built assembled wall 100 may be made of a suitable material to ensure proper functionality. The frame, and its various elements, including the frame fasteners (not shown) may be made of a high strength metal such as stainless steel or aluminum alloy, or potentially other durable materials such as wood or hard plastics. The cover panels 102 may be made of a suitably lightweight material such as plasterboard or wood but may also use alternative materials such as marble in order to achieve a desired design aesthetic. Decorative, alternative materials may only be used on portions of the cover panels 102 that are outwardly visible upon engagement with the frame 101. Other components such as the base skirt 103, support 104 and any utilized screws or other hardware may be made of a suitably strong material, similar to those of the frame, including strong metals, woods and plastics.

Certain buildings or structures may not need every wall to be load bearing, such as those that employ steel support structures. Said fast built assembled wall 100 may be used to divide a room quickly and easily while not actually bearing any weight from the surrounding structure. This may allow the fast built assembled wall 100 to be removed or selectively repositioned based on the needs and preferences of the user. The innate modularity of the wall also allows it to be stored and transported quickly and easily, which will be discussed in greater detail hereinbelow.

Figure 2:
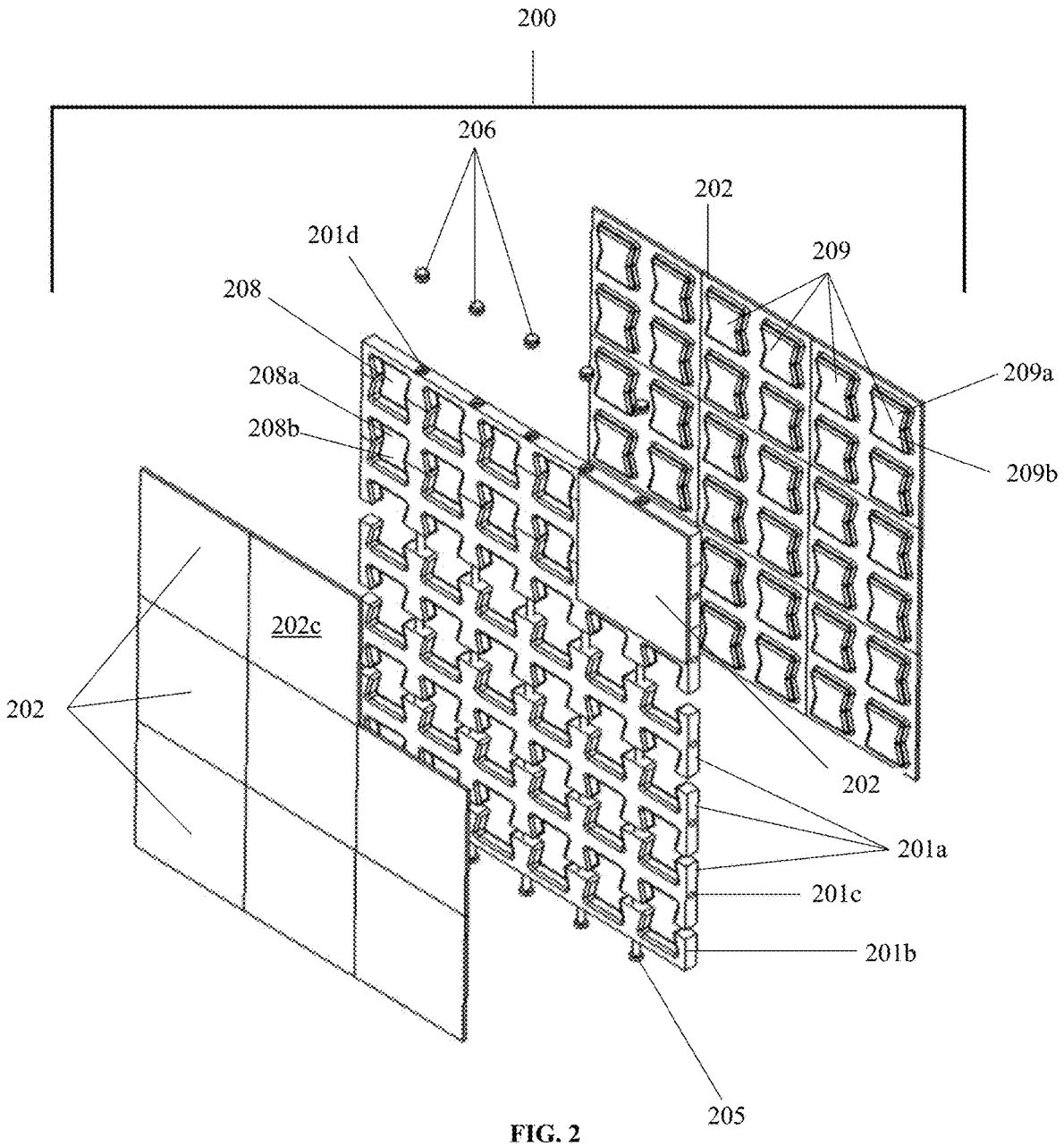
FIG. 2 illustrates the exploded view of a first embodiment of the disclosed fast built assembled wall, according to an aspect.

FIG. 2 illustrates the exploded view of a first embodiment of the disclosed fast built assembled wall 200, according to an aspect. As can be seen in FIG. 2, the center frame sections 201*a* and end frame sections 201*b* of the frame 201 may be held together through the utilization of joining rods 205, configured to engage with each frame section 201*a*, 201*b* to adjoin them. In this first disclosed embodiment of the frame 201, each frame section may be further comprised of a plurality of nested rod ports 201*d* configured to surround a joining rod 205. When each frame section is properly aligned, as described hereinabove, the rod ports nested within each frame section may be coaxially aligned with rod ports nested within other frames and the rod body, such as rod body 505*a* of FIG. 5A, to facilitate the housing of each joining rod 205 within the frame 201. This joining rod 205 may travel through and be nested within the corresponding set of coaxially aligned rod ports 201*d* from each frame section 201*a*, 201*b*, such that each joining rod 205 is partially housed within a singular rod port 205 from each frame section upon engagement with the frame.

Figure 5A:
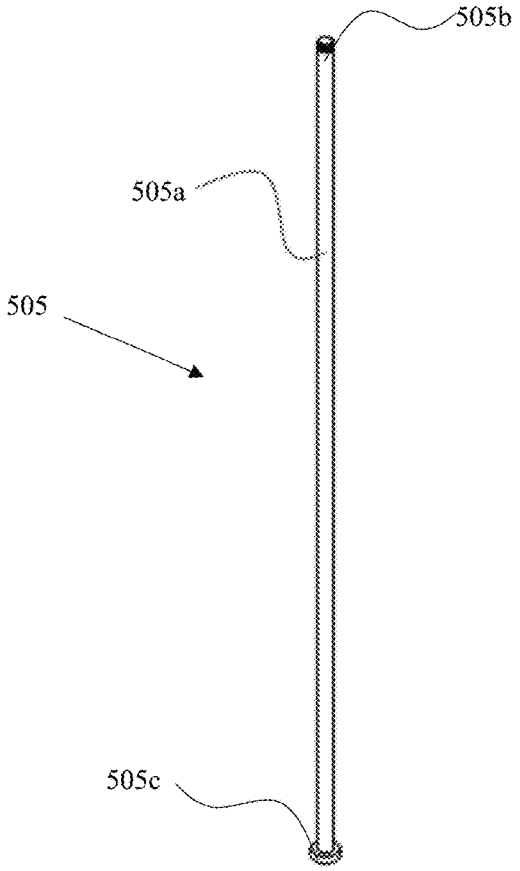
FIG. 5A-5C illustrates the front views of the joining rod, its threaded end and its wide end, respectively, according to an aspect.

Each joining rod 205 may have a threaded end, such as threaded end 505*b* of FIG. 5A, configured to travel through each corresponding rod port 201*d* before engaging with a securing nut 206, as well as a wide end, such as wide end 505*c* of FIG. 5A, configured to be too large to travel through the rod ports 201*d*. As such, upon the threaded end of the joining rod 205 traveling through each corresponding rod port 201*d* and engaging with the securing nut 206, each frame section 201*a*, 201*b* may be secured between the wide end and threaded end of the joining rod 205. The features and aspects of the joining rod and a corresponding securing nut 206 configured to engage with each joining rod 205 will be described in FIGS. 5A-5C and FIGS. 6A-6D, respectively.

As disclosed hereinabove, the engagement of each cover panel 202 with the frame 201 may be facilitated by the usage of a mortise-tenon engagement structure. Each center frame section 201*a* may have the necessary shape to form a plurality of upper mortise section 208*a* for a first plurality of mortises and a plurality of lower mortise sections 208*b* for a second plurality of mortises. Each end frame section 201*b* may have the necessary shape to from either a plurality upper mortise sections 208*a* or a plurality of lower mortise sections 208*b*, such that upon engagement with a center frame section 201*a*, a plurality of mortises is formed. As such, whenever any two frame sections 201*a*, 201*b* are engaged, at least a singular mortise 208 is formed between them, as a result of the adjoining of an upper mortise section 208*a* from a first frame section with the lower mortise frame section 208*b* from a second frame section.

Each formed singular mortise 208 is configured to engage with a singular tenon 209. In the disclosed embodiments, each cover panel 202 may have four tenons 209, but it should be understood that this number may be varied based on the size of each cover panel. Similarly to the disclosed mortises 208 formed within the assembled frame 201, each tenon 209 may have an upper tenon portion 209*a* and a lower tenon portion 209*b*. When each tenon 209 engages with a corresponding mortise 208, the upper tenon portion 209*a* may be nested within the corresponding upper mortise section 208*a* and the lower tenon portion 209*b* may be nested within the corresponding lower mortise section 208*b*. Unlike the mortises 208, the tenons 209 may be fully formed regardless of the current configuration of the fast built assembled wall 200 or its elements.

It is important to note that the way that the way that the disclosed fast built assembled wall 200 is constructed allows for it to not only be quickly assembled from its base components (e.g., end frame sections 201*b*, center frame sections 201*a*, cover panels 202, and frame fasteners such as the disclosed joining rods 205 and securing nuts) but also quickly disassembled when said wall 200 is no longer needed or needs to be moved. Assembly of the frame 201 may be particularly simple, as each center frame section 201*a* is interchangeable with other center frame sections 201*a*, so no particular order of frame sections is required. The herein disclosed frame fasteners are configured to allow the frame sections 201*a*, 201*b* to be both quickly and easily assembled and disassembled based on the needs of the user. For example, the joining rods 205 may be inserted through corresponding, axially aligned rod ports 201*d* to allow the joining rod to be nested within each frame section, thus joining them together and assembling the frame 201, or alternatively, be removed from each rod port to facilitate the disassembly of the frame/wall. This is also true for walls that utilize other frame fasteners such as the disclosed combination of hinges, hooks and loops of FIG. 7A-7B, as will be discussed in greater detail hereinbelow. The modular nature of the fast built assembled wall 200 allows it to be unpackaged and assembled quickly and easily, and then disassembled and repackaged quickly and easily as well, allowing the wall 700 to go between being stored and installed with ease. The modular nature of the fast built assembled wall 200 may allow a user to quickly and easily change the style or theme of a room by personalizing these walls 200, through the usage of a changeable panel face ("panel faces") 202*c* on each cover panel 202, as will be disclosed in greater detail hereinbelow.

Figure 3A:
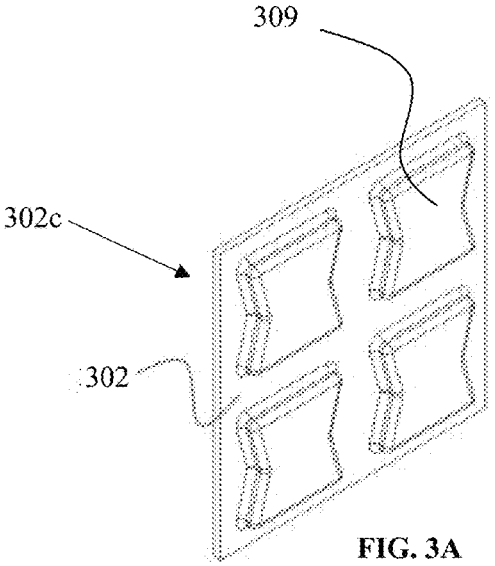
FIGS. 3A-3B illustrates the top perspective and front views, respectively, of the disclosed cover panel, according to an aspect
Figure 3B:
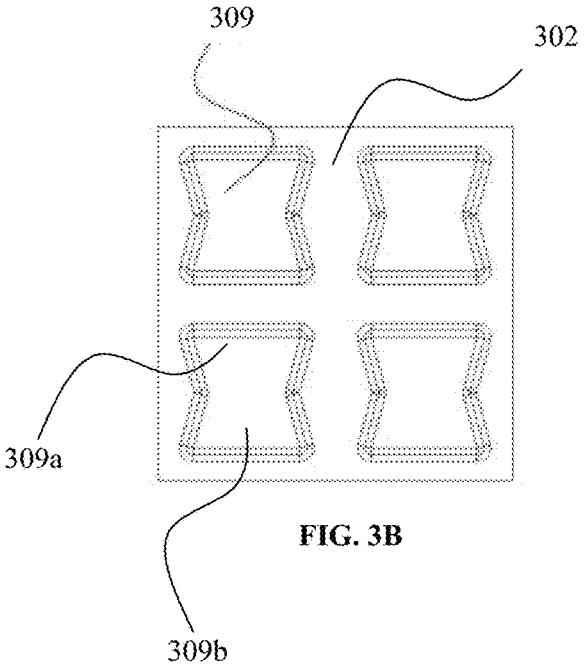

FIGS. 3A-3B illustrates the top perspective and front views, respectively, of the disclosed cover panel 302, according to an aspect. Each cover panel 302 may have a panel face 302*c* and plurality of protruding tenons 309, wherein the plurality of tenons is configured to engage with corresponding mortises formed within the frame of the fast built assembled wall. A panel face 302*c* may be associated with the tenon(s) 309 such that said panel face 302*c* is outwardly visible upon the cover panel's engagement with the frame. The panel face 302*c* may be a decorative element or provide a surface for a decorative element to be displayed upon, allowing a user to customize this wall without needing to paint it. For example, user may replace a first set of installed panel faces 302*c* with a second set of new faces to change the color, style, design etc., of the assembled wall. As mentioned hereinabove, the depicted four tenon 209 configuration of the disclosed cover panels is just one potential embodiment that may be utilized. In an alternative embodiment, a cover panel may have only one or two tenons, while in other alternative embodiments, said cover panel may have more than four tenons. Further details regarding the cover panels 302 and their corresponding tenons 309 will be discussed hereinbelow.

As depicted herein, the shapes of the tenons 309 and the corresponding mortises (not shown) may be complementary to allow for the tenon and mortise to engage properly. Certain shapes of mortise and tenon 309 may also positively influence the structural stability of the frame and thus the overall structure of the fast built assembled wall. One such shape is the "double trapezoid", such as the double trapezoid shaped tenon 209 of FIG. 2 and the double trapezoid shape of the corresponding mortise, such as the double trapezoid shaped mortise 208 of FIG. 2. The shape of the of the double trapezoid is such that the middle portion of the tenon/mortise is narrower and the terminal ends (top/bottom) of the tenon/mortise are wider. One consequence of this is that once a double trapezoid tenon is engaged/nested within a double trapezoid mortise, the upper mortise section 208*a* cannot be slid up and the lower mortise section 208*b* can not be slid down.

The rotational and lateral movement of the upper mortise section and lower mortise section may also be restricted upon engagement with a tenon 309. This feature is particularly relevant for the disclosed frame structure, wherein the upper mortise section 208*a* and the lower mortise section 208*b* are on separate structures which need to remain adjoined during use, as seen in FIG. 2. When used in conjunction with a frame fastener, such as the aforementioned joining rod, the shape of the mortises/tenons 309 helps to prevent the frame from falling apart or separating during use. Shapes having this same characteristic of a narrow center portion and wider terminal ends (upper and lower portions) may also be utilized for the shape of the mortises/tenons. For example, a possible alternative mortise/tenon shape may have a narrow central column disposed between and associated with a wider circular top portion and a wider circular bottom portion, thus creating a rounded, dumbbell-like shape having a narrow middle portion disposed between a wide top portion and a wide bottom portion.

While other shapes of mortise/tenon 309 may be possible, the disclosed double trapezoid shape may be preferred in many cases for its simplicity and robustness. One advantage of the disclosed double trapezoid shape is that said shape may be easier to manufacture, as this shape is easier to cast and smoother than the alternative example described hereinabove. Another advantage is that the generally larger size of the double trapezoid shape, when compared to the alternative tenon/mortise shape described hereinabove. This larger shape of the double trapezoid may provide more space within each tenon 309 to store insulative materials, such as insulation cushion 307 of FIG. 3F. It should be understood that a frame fastener may be described as the first structure used to adjoin the frame sections together in the correct orientation during frame assembly, whereas the tenons 309 may be described as the second structure used to adjoin the frame sections together in the correct orientation during assembly.

Figure 3C:
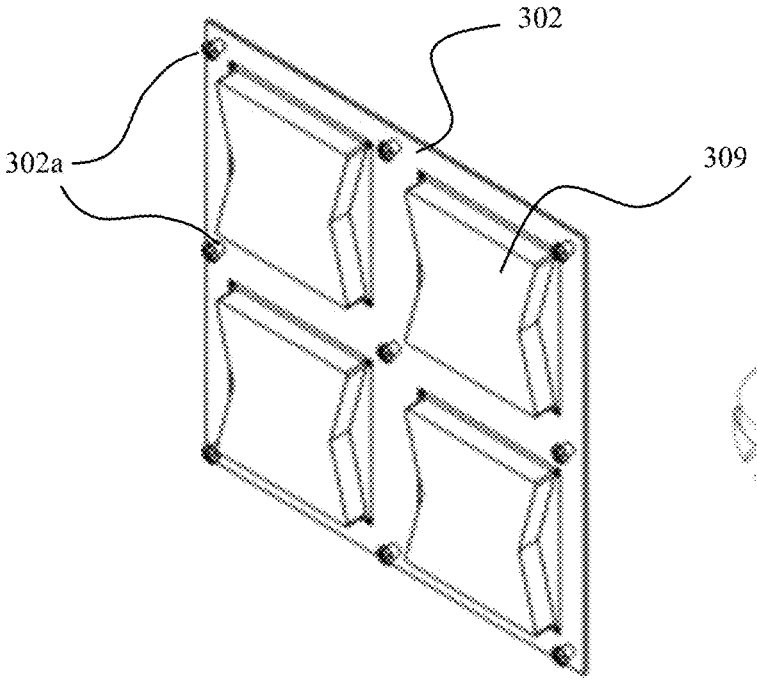
FIG. 3C illustrates the top perspective view of an alternative embodiment of the disclosed cover panel having securing rivets, according to aspect.
Figure 3D:
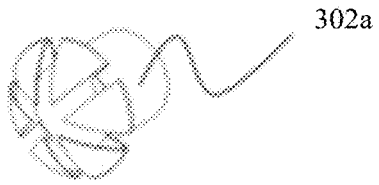
FIG. 3D illustrates the top perspective view of a securing rivet, according to an aspect.

FIG. 3C illustrates the top perspective view of an alternative embodiment of the disclosed cover panel having securing rivets 302*a*, according to aspect. FIG. 3D illustrates the top perspective view of a securing rivet 302*a*, according to an aspect. In order to allow for the cover panels 302 to more securely engage with the frame, said cover panels 302 may be provided with attached securing rivets 302*a* configured to be inserted into rivet slots, such as rivet slots 912 of FIG. 9A, within the frame. Each cover panel 302 may be provided with nine securing rivets 302*a*, such that there is a securing rivet 302*a* disposed at the corner of each tenon 309. In an alternative embodiment having only a singular tenon 309, said cover panel may have only four securing rivets, again, having one at disposed near each corner of the tenon 309. While a greater quantity of smaller cover panels 302 may be utilized, it may be preferable to use a lesser quantity of larger panels to make the assembly process more convenient. It should be understood that the size/quantity of cover panels 302 may be varied depending on the needs of the user. The utilization of these securing rivets 302*a* attached to the cover panel 302 may help to further strengthen the connection between each cover panel 302 and the frame by directly securing corresponding frame sections together. These securing rivets 302*a* may also further ensure each tenon 309 remains engaged within the corresponding mortise, which also helps secure each frame section together as disclosed hereinabove. Each securing rivet 302*a* may have an umbrella-like shape, as seen in FIG. 3D, which is compressed into rivet slot to facilitate a secure engagement between corresponding elements.

Figure 3E:
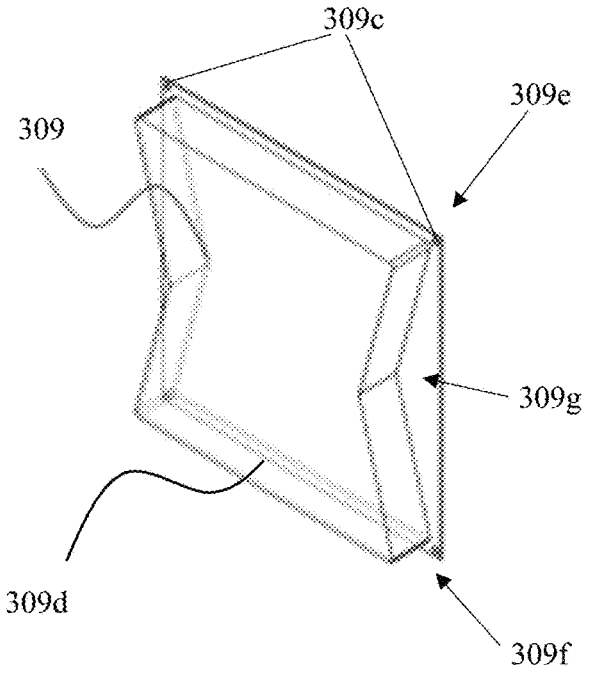
FIG. 3E illustrates a perspective view of the disclosed tenon having a plurality of adjoining screws, according to an aspect.
Figure 3F:
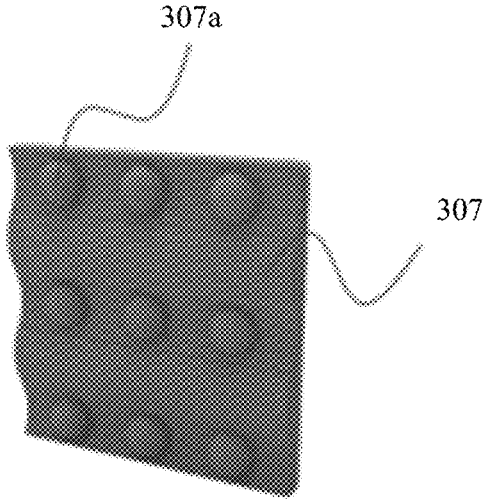
FIG. 3F illustrates the front perspective view of an insulation cushion configured to be housed within a corresponding tenon, according to an aspect.
Figure 3G:
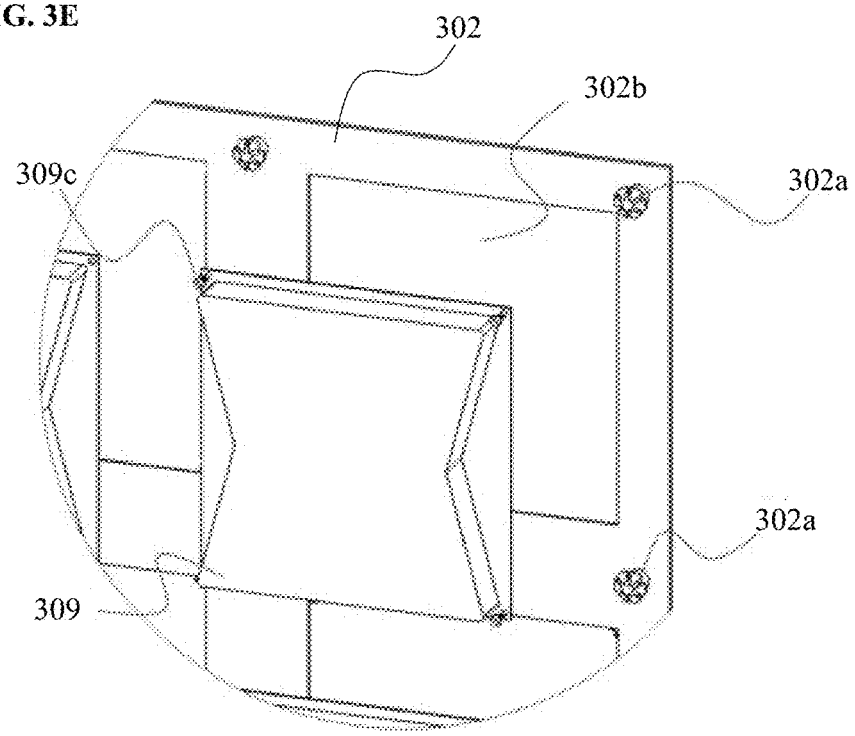
FIG. 3G illustrates the front perspective view of tenon being engaged with the securing pocket of a corresponding cover panel, according to an aspect.

FIG. 3E illustrates a perspective view of the disclosed tenon having a plurality of adjoining screws, according to an aspect. FIG. 3F illustrates the front perspective view of an insulation cushion configured to be housed within a corresponding tenon, according to an aspect. FIG. 3G illustrates the front perspective view of tenon being engaged with the securing pocket of a corresponding cover panel 302, according to an aspect. The semi-transparent view of the tenon 309 in FIG. 3E illustrates a tenon embodiment having a hollow tenon pocket 309*d*. In order to facilitate selective removal of each tenon portion 309 from its corresponding cover panel 302, each tenon 309 may be secured to the corresponding cover panel by tenon screws 309*c*. Upon the seating of the tenon 309 within a tenon insert 302*b* nested within the cover panel 302, the tenon screws 309*c* may be used to engage the tenon 309 with the cover panel 302 to provide a secure engagement of the tenon 309 to the cover panel 302.

In order to allow the disclosed fast built assembled wall to provide both heating and sound insulation, it may be necessary to utilize insulative materials within the structure of the said wall. For example, each selectively removable tenon 309 may have a tenon pocket 309*d* configured to house an insulative material, such as an insulative cushion 307, configured to insulate against heat and/or sound. The selectively removable nature of the tenon 309 allows for it to be removed from the cover panel 302 to be filled with said insulative cushion 307 prior to reinstallation on the cover panel 302. Each insulative cushion 307 may have protruding shapes 307*a* configured to disturb sound wave transmission, thus allowing them to effectively provide sound insulation. Each insulative cushion 307 nested within a tenon 309 may be made of the same material, which may be capable of providing sound and/or heat insulation.

As disclosed hereinabove, the tenon 309 may have a shape having certain characteristics, and the mortise it is configured to snuggly engage with may have a complementary shape having the same characteristics. The tenon 309 of FIG. 3E may be identified as having a double trapezoid shape, wherein said tenon has a wide upper portion 309*e*, wide lower portion 309*f* and narrow middle portion 309*g* disposed between and associated with the wide upper portion 309*e* and the wide lower portion 309*f* The mortise that said tenon is configured to snuggly engage with may have comparable characteristics, such as wide upper section, wide lower section and narrow middle section, to effectively engage the tenon 309. Such a shape may be desirable for this application, wherein the mortises are formed from two separate objects because the shape of the tenon helps to pull each corresponding frame section together while engaged, thus ensuring maintained frame stability. Both this described mortise-tenon interaction, and the disclosed frame fastener (s), may be used to ensure the formed fast built assembled wall remains stable and intact after installation. As such the disclosed frame fasteners may be referred to as a "primary engagement device" whereas the tenons may be referred to as a "secondary engagement device".

It should be understood that each tenon 309 and its corresponding mortise may be correspondingly shaped, such that the shape of the tenon 309 and shape of said mortise are complementary to facilitate the snug fitting of each tenon 309 within the mortise. As can be seen in FIG. 2, each tenon 209 has a double trapezoid shape that is configured to fit snuggly/firmly within a corresponding mortise 208 formed within the frame 201. This snug engagement of the each tenon 209 with a corresponding mortise allows 208 for adjacent frame sections to be more securely interconnected, as each mortise section 208*a*, 208*b* of a frame section is configured to snuggly engage with corresponding tenon portion 209*a*, 209*b* on the cover panel 202 to prevent independent movement individual frame sections while engaged.

Figure 4A:
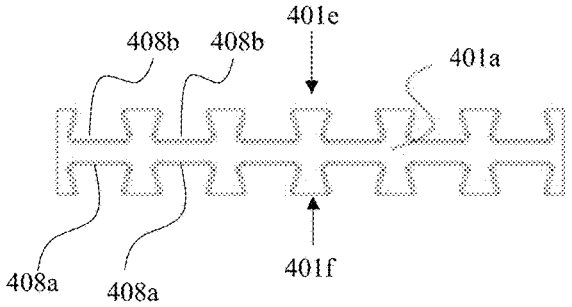
FIG. 4A-4C illustrates the front, top and perspective views, respectively, of a first embodiment of a center frame section, according to an aspect.
Figure 4B:
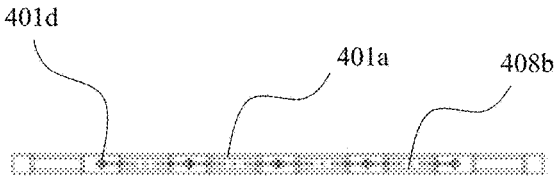
Figure 4C:
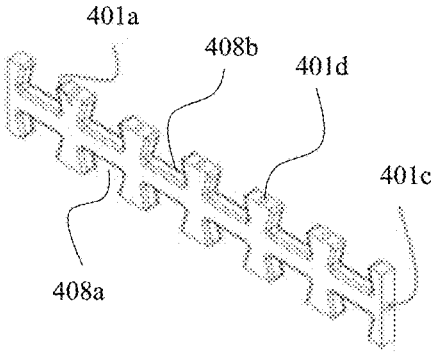

FIG. 4A-4C illustrates the front, top and perspective views, respectively, of a first embodiment of a center frame section 401*a*, according to an aspect. As disclosed hereinabove, each frame section of a frame that is not disposed at the top or bottom of said frame may be identified as a center frame section 401*a*. Each center frame section 401*a* may be identical and have a suitable structure to provide a plurality of upper mortise sections 408*a* for a first plurality of mortises, and a plurality lower mortise sections 408*b* for a second plurality of mortises. Upon engaging with a corresponding center frame section or end frame section, the upper mortise sections 408*a* or lower mortise sections 408*b* may be aligned with corresponding lower mortise sections 408*b* or corresponding upper mortise sections 408*a*, respectively, to form a plurality of complete mortises, as shown by mortise 208 of FIG. 2. As disclosed hereinabove, these mortises may be a suitable shape, such as a double trapezoid, which allows a complementary shaped tenon to be inserted within each mortise to facilitate a secure engagement of the corresponding frame sections.

One notable benefit of utilizing identical center frame sections 401*a* for each non-terminating frame section is that the complexity associated with producing the necessary parts to build the fast built assembled wall may be kept low. Additionally, the height of the fast built assembled wall may be governed by the amount of center frame sections 401*a* used for a particular wall, as well as the length of the associated joining rod used to adjoin them, if applicable. Each center frame section 401*a* may have a plurality rod ports 401*d*, each being configured to surround a portion of a nested joining rod. Each rod port 401*d* may be configured to align with corresponding rod ports 401*d* on adjoining center frame sections 401*a* and end frame section 401*b*, such that each joining rod is configured to travel through one rod port 401*d* in each frame section 401*a*, 401*b*. Other frame fasteners that will be discussed in detail hereinbelow, such as the hinge-hook based assemblies of FIG. 7A, may not need a joining rod of a corresponding size to produce a variable height wall. Each center frame section may have a bypass hole 401*c* running horizontally through its length, such that a wire or other object may travel through the center frame section while being discretely concealed to maintain the desired aesthetic of the wall.

As can be seen in FIG. 4A, each center frame 401*a* may have a centrosymmetric design, having a plurality of lower mortise section 408*b* nested within its upper half 401*e* and a plurality of upper mortise sections 408*a* nested within its lower half 401*f*. Each plurality of lower mortise sections 408*b* nested within a particular center frame section 401*a* may be configured to align with a corresponding plurality of upper mortise sections 408*a* from an adjacent frame section to form a plurality of mortises between the particular center frame section 401*a* and the adjacent frame section. The adjacent frame section may be an end frame section, such as end frame section 401*b* of FIG. 4D, which will be described in greater detail hereinbelow.

Figure 4D:
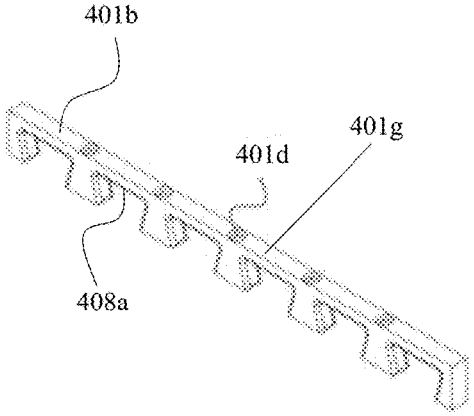
FIG. 4D illustrates the perspective view of a first embodiment of an end-frame section, according to an aspect.

FIG. 4D illustrates the perspective view of a first embodiment of an end-frame section, according to an aspect. The structure of an end-frame section 401*b* may differ somewhat from that of a center frame section 401*a*, as each end frame section 401*b* may have only a plurality of upper mortise sections 408*a* or a plurality of lower mortise sections 408*b*, depending on its orientation. The end frame section 401*b* of FIG. 4D is oriented as an upper end frame section 401*b*, but may be suitably rotated to be a lower end frame section, thus having each upper mortise sections 408*a* become a lower mortise sections. Similarly to the center frame section 401*a* of FIG. 4A-4C, each rod port 401*d* within the end frame section 401*b* may be configured to coaxially align with corresponding rod ports for each center frame section 401*a* and the other end frame section 401*b*, such that a corresponding rod port may be nested within a set of coaxially aligned rod ports from each frame section 401*a*, 401*b* to adjoin each frame section 401, 401*b* within a frame. Due to each end frame section 401*b* having the same structure and each center frame section having the same structure, two different types of frame sections (and correspondingly long joining rods) may need to be produced to facilitate walls of any height.

Unlike the prior disclosed center frame sections 401*a* of FIG. 4A-4C, the end frame sections 401*b* may not be centrosymmetric in shape. These end frame sections 401*b* may have either a plurality of lower mortise sections or a plurality of upper mortise sections, depending on how they are oriented (e.g., whether it is an upper end frame section, such as upper end frame section 901*b*-1 of FIG. 9A, or a lower end frame section, such as lower end frame section 901*b*-2 of FIG. 9A). A terminal surface 401*g* may be disposed on the side of the end frame section 401*b* that is opposite mortise sections, said terminal surface having no mortise sections. This terminal surface 401*g* is not configured to engage directly with another frame section and instead may engage with either a support mount if the corresponding end frame section is disposed at the top of a frame or a base skirt if the corresponding end frame section is disposed at the bottom of the frame. The disclosed end frame section of FIG. 4D may be described as an upper end frame, given that its depicted orientation provides a plurality of upper mortise sections 408*a*.

Figure 5B:
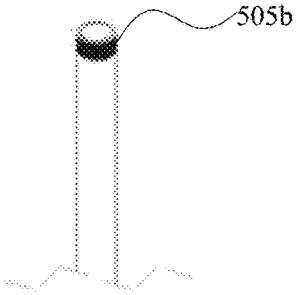
Figure 5C:
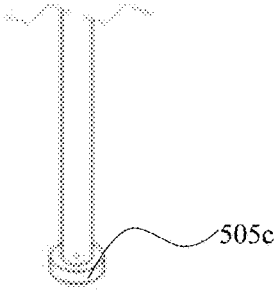
Figure 6A:
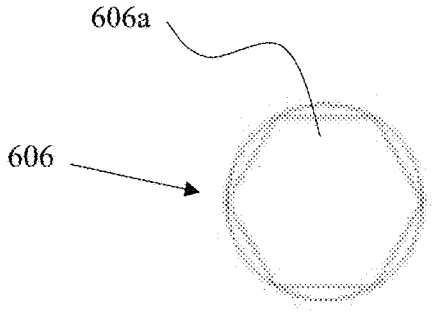
FIG. 6A-6D illustrates the top, bottom, side and front perspective view of the disclosed locking nut, according to an aspect.
Figure 6B:
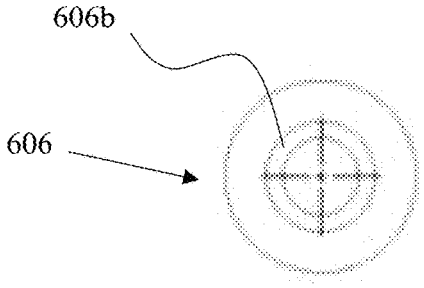
Figure 6C:
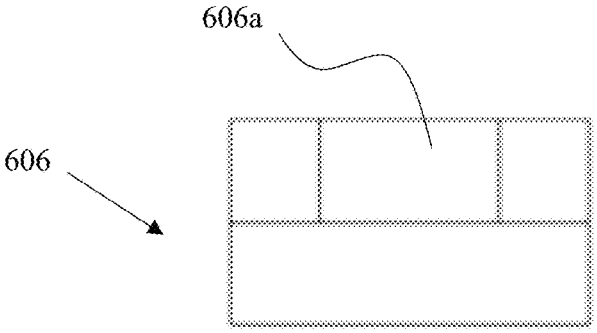
Figure 6D:
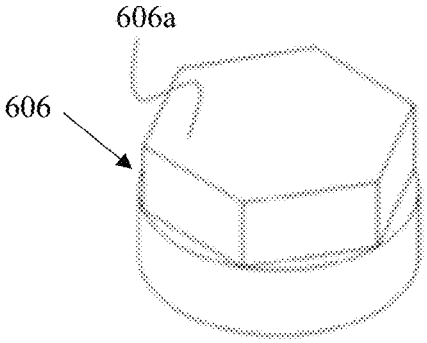

FIG. 5A-5C illustrate the front views of the joining rod, its threaded end 505*b* and its wide end 505*c*, respectively, according to an aspect. The joining rod 505 may be used to adjoin frame sections within a frame that have coaxially aligned rod ports, as disclosed hereinabove. The joining rod may be comprised of a rod body 505*a* disposed between and associated with a threaded end 505*b* and a wide end 505*c*. For each set of coaxially aligned rod ports present in a frame, the threaded end 505*b* of the joining rod 505 may be inserted through said set of coaxially aligned rod ports to join each frame section together, such that each rod port surrounds a portion of the rod body 505*a*. Once the joining rod 505 is nested within each rod port, a securing nut, such as securing nut 606, may be engaged with the threaded end 505*b* of the joining rod 505. By doing so, each frame section may now be trapped between the attached securing nut and the wide end 505*c*, which are disposed on opposite ends of the rod body 505*a*. If disassembly is required, the securing nut may be removed using an appropriate tool to allow each frame section to be slid off the joining rod body 505*a* by traveling over the threaded end 505*b* of said joining rod 505.

FIG. 6A-6D illustrates the top, bottom, side and front perspective views, respectively, of the disclosed locking nut 606, according to an aspect. As described hereinabove, the locking nut 606 is configured to engage with the threaded end of joining rod to secure the joining rod to each frame section. The locking nut 606 may have a hexagonally shaped head 606*a* or any other shaped head that allows for manipulation of the nut using an appropriate tool, such as a wrench. The threaded portion 606*b* may be appropriately sized to be engaged with the threaded end of joining rod to secure the two elements together. It should be understood that the locking nut 606 is sufficiently larger than the rod ports on the frame sections, such that said frame sections cannot be forced over the securing nut 606. By securing each frame section between the locking nut 606 and the wide end of the joining rod, such as wide end 505*c* of joining rod 505, the frame sections may be secured together to form the necessary mortises to allow for engagement of the corresponding tenons, and thus complete assembly of the disclosed embodiment of the fast built assembled wall.

Figure 7A:
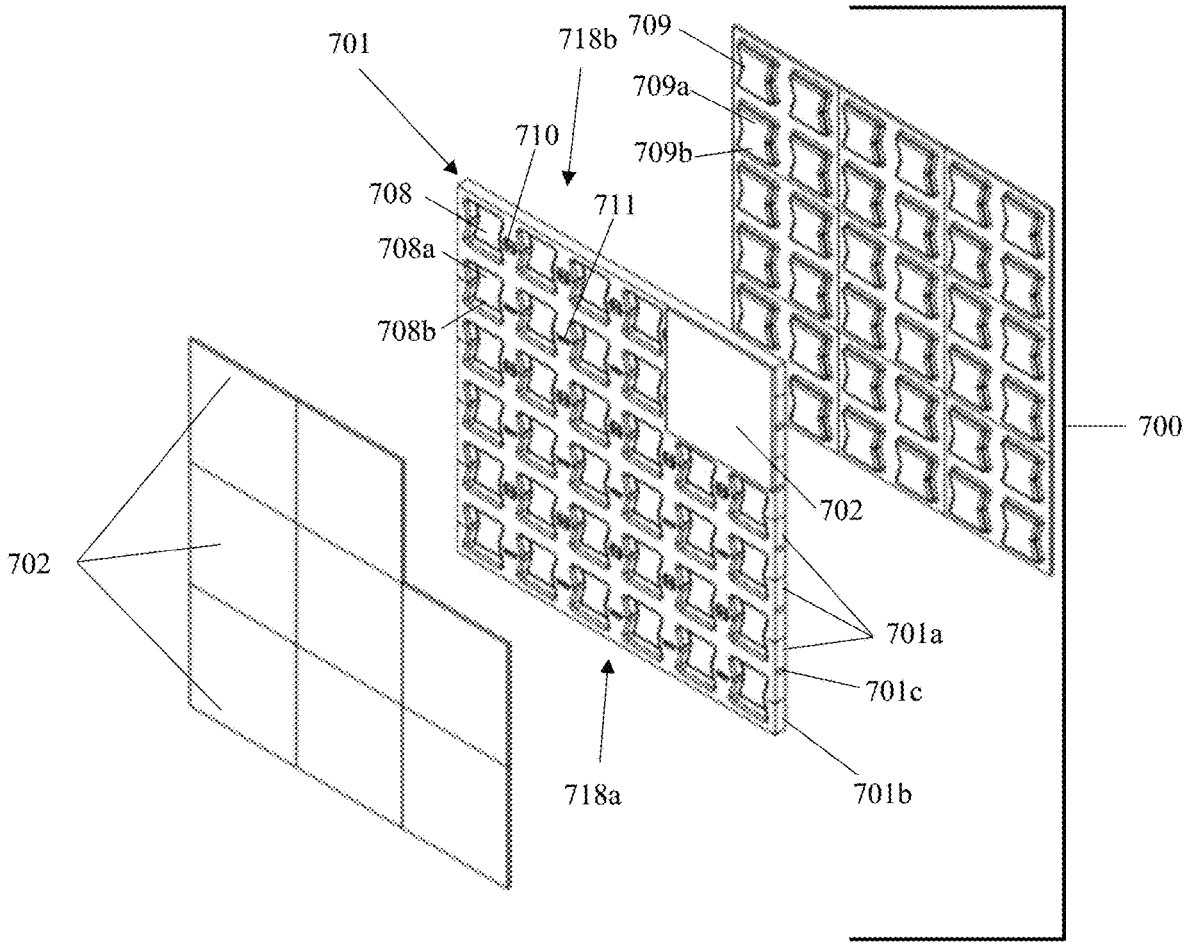
FIG. 7A illustrates the exploded view of a second embodiment of the disclosed fast built assembled wall, according to an aspect.
Figure 7B:
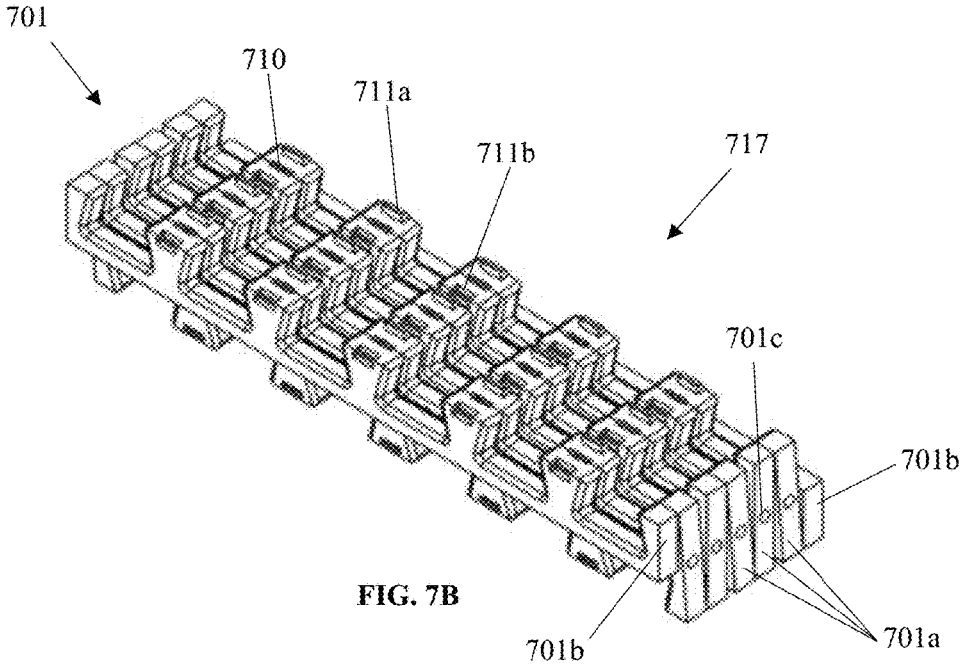
FIG. 7B illustrates the front perspective view of the frame of the second embodiment of the disclosed fast built assembled wall in a folded configuration, according to an aspect.

FIG. 7A illustrates the exploded view of a second embodiment of the disclosed fast built assembled wall, according to an aspect. FIG. 7B illustrates the front perspective view of the frame of the second embodiment of the disclosed fast built assembled wall in a folded configuration, according to an aspect. In addition to using the prior disclosed attachment method of providing a joining rod configured to be nested within corresponding rod ports, other frame fasteners may be utilized. As illustrated in the exploded view of FIG. 7A, each center frame section 701*a* and end frame section 701*b* may alternatively be adjoined through the utilization of hinges 710 and hook systems ("snap joints") 711. Depending on how the hinges 710 and hook systems 711 are arranged and oriented within frame 701, certain additional benefits may be provided. By alternating the positioning of hinges 710 and hook systems 711 between adjacent frame sections 701*a*, 701*b* as seen in FIG. 7A, the frame 701 may be capable of being folded, as seen in FIG. 7B, allowing for the frame 701 to be partially preassembled, neatly folded and transported easily. From the folded position, the frame 701 may be fully assembled by simply rotating the hinges 710 such that a hook 711*a* and a loop 711*b* from each hook system 711 engages with each other to fully secure adjacent frame sections together. While the frame 701 is in this folded position, the frame may be referred to as an accordion style stack 717. This accordion style stack 717 may be transported and/or packaged more easily than a flat wall, due to having a generally smaller size that is significantly less cumbersome. The configuration of the hinges 710 and hook system 711 will be described in greater detail hereinbelow.

As with the first embodiment of the fast built assembled wall depicted in FIG. 2, each tenon 709 on each cover panel 702 may be configured to engage with a corresponding mortise 708 formed by the engagement of adjacent frame sections 701*a*, 701*b*. An upper tenon portion 709*a* of each tenon 709 may be configured to engage with an upper mortise section 708*a* of a corresponding formed mortise 708, whereas a lower tenon portion 709*b* of each tenon 709*a* may be configured to engage with a lower mortise section 708*b* of a corresponding formed mortise 708. The engagement of each tenon 709 with its corresponding mortise 708 helps the prevent frame from collapsing (e.g., returning to the folded position of FIG. 7B) while in use, while also reducing any vertical strain that be experienced by the hinges 710 or hook system 711. Once again, the shape of the mortise 708 and tenon 709 may be configured such that the frame sections may be kept in planar alignment, as shown in FIG. 7A.

By having each cover panel 702 engage with two different frame sections, the structural integrity of the frame may be further maintained while the wall is assembled. Much like the frame sections of previous embodiments, each center frame section 701*a* may also have a bypass hole 701*c* to allow wires to travel through the wall. Much like the previously disclosed center frame section 401*a* of FIGS. 4A-4C, the center frame sections 701*a*, 801*a*, etc. of FIG. 7A and beyond are centrosymmetric, as long as the hinges 710 and hook system 711 are understood to be elements that are distinct from the main structure of the frame sections. These centrosymmetric designs of the center frame sections help minimize manufacturing costs.

It should be noted that for the disclosed tenon/mortise shapes, the tenons 709 also effectively prevent the rotation and vertical movement of each frame section it engages with as a result of engaging with the formed mortise 708. Because the shape of the tenon 709 allows both the upper mortise section 708*a* and the lower mortise section 708*b* of a mortise 708*a* to wrap around and engage with a corresponding portion of tenon 709, it is not possible to move or rotate either mortise section 708*a*, 708*b* independently of each other while the tenon is secured within the corresponding mortise 708. This mechanism of a tenon 709 configured to snuggly engage with a corresponding mortise 708 effectively provides and additional mechanism to further secure each adjacent frame section of the frame 701 together.

It should be understood that the hereinabove described "rotational movement" refers to the rotation facilitated by the selective rotation of the hinges 710. Preventing rotational movement of the frame sections (e.g., rotation to any position that is does not result in a fully assembled, unfolded, planar frame 701, as seen in FIG. 7A) prevents the collapse of the frame into any undesirable, non-operational orientations. These undesirable orientations may include any configuration in which the frame is partially or completely folded, which would prevent the frame 701 from providing a suitable wall surface. While the herein described hooks 711*a* and loops 711*b* may act as the primary mechanism used to lock the frame 701 into the assembled orientation to facilitate assembly of the wall 700 when used in conjunction with the hinges 710, the engagement of the tenons 709 with their corresponding mortises 708 may also help to further secure the frame 701 in its planar, fully assembled configuration by also preventing rotational motion while engaged.

Upon being fully assembled, a frame 701 may have both a front surface 718*a* and a back surface 718*b*, in which the mortises are nested. It should be understood that a singular mortise may be accessible from both the front surface 718*a* and the back surface 718*b* of the frame to allow a tenon to engage with both surfaces 718*a*, 718*b* of the frame. In fact in order to provide a wall capable of providing insulative capabilities while maintaining a uniform design aesthetics, it may be necessary to cover the front surface 718*a* and the back surface 718*b* of the frame 701 with cover panels 702, as shown by the exploded view of FIG. 7A. Covering both surface 718*a*, 718*b* of the frame 701 with cover panels also provides support to the frame as a result of the engagement of the tenons 709 with both accessible sides of each mortise 708. As described hereinabove, each tenon 709 and its corresponding mortise 708 may have a complementary shape, such that the tenon is configured to snuggly engage with the mortise 708 to both secure the corresponding cover panel 702 to the frame 701 and further secure the corresponding adjacent frame sections together.

As disclosed hereinabove for the rod-based frame fastener of FIG. 2, the hinge-based frame fastener (the hinges 710 and hook system 711) of FIG. 7A-7B may also allow the fast built assembled wall to be quickly and easily assembled and disassembled. For example, the hinges 710 on each applicable frame section 701*a*, 701*b* may be quickly unfolded such that each hook 711*a* engages with a corresponding loop 711*b* to form the assembled wall frame as seen in FIG. 7A, which may then engage with a plurality of cover panels to form the disclosed wall 700 quickly and easily. Alternatively, an already assembled wall 700 may be quickly and easily disassembled by removing the cover panels from the frame (by disengaging each tenon 709 from its corresponding mortise 708) and disengaging each hook 711*a* from its loop 711*b* to allow the frame to fold into an accordion style stack 717 as seen in FIG. 7B. The capability of this fast built assembled wall to be quickly and easily built from its loose components to its assembled state, and vice versa allows the wall to be quickly implemented when needed and quickly removed when not, allowing for use, reuse and storage of components as needed. Even while assembled, the wall 700 be capable of being moved, allowing for quick adjustments to be made without needing to fully disassemble it.

Figure 8A:
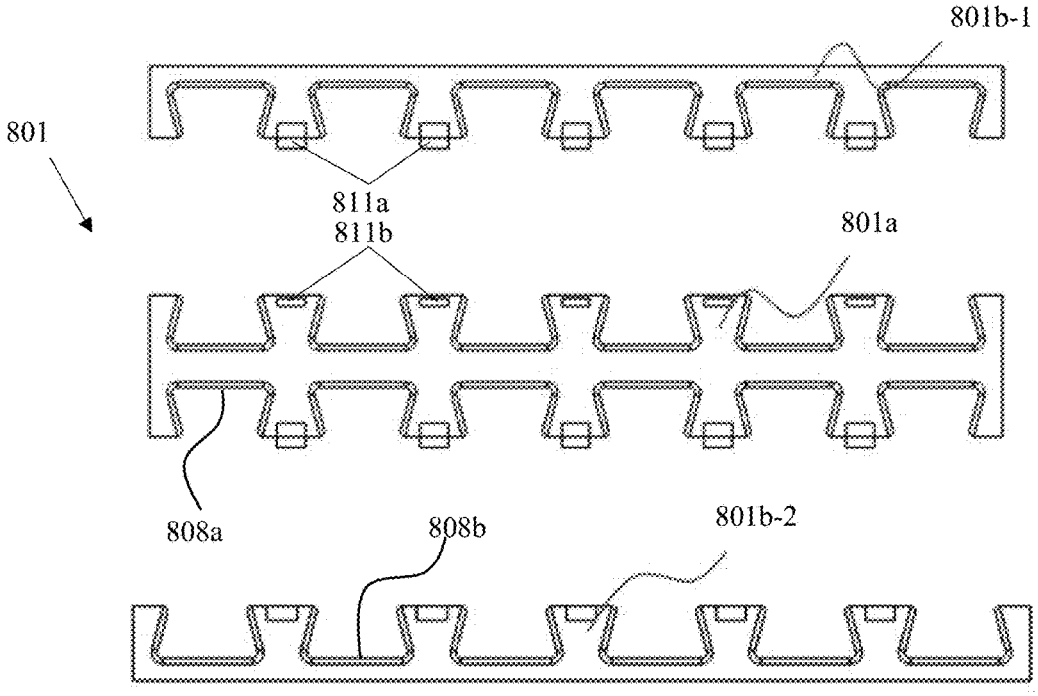
FIG. 8A illustrates an exploded view of the frame of the second embodiment of the disclosed fast built assembled wall, according to an aspect.

FIG. 8A illustrates an exploded view of the frame 801 of the second embodiment of the disclosed fast built assembled wall, according to an aspect. In order to facilitate the rapid, selective deployment of the frame 801 of the fast built assembled wall, it may be necessary to utilize a frame fastener that is quick and easy to use, while still being configured to firmly secure each frame section together. As a result of the hinges, such as hinge 710 of FIG. 7, being fixed to their corresponding frame sections, the selective transition between the folded, disassembled state of FIG. 7B and the straightened, deployed state of FIG. 7A is reliant upon the engagement of hooks 811*a* on one frame section 801*a*, 801*b*-1, 801*b*-2 with loops 811*b* on another frame section 801*a*, 801*b*-1, 801*b*-2, as described for the hook system 711 of FIG. 7. In order for the frame 801 to be deployed, each hook 811*a* must be engaged with a corresponding loop 811*b*. This engagement may be reversible, such that the frame may be later folded as necessary.

It should be understood that at least one frame fastener may need to be utilized to interconnect the frame section. This may include a singular joining rod, such as joining rod 505 engaged with a singular securing nut, or a singular hinge and singular hook system disposed between each adjacent frame section, such as hinge 710 and hook system 711 of FIG. 7A-7B. It should also be understood that utilizing a plurality of frame fasteners, such as multiple joining rods and securing nuts, or multiple sets of hinges and hook systems between each adjacent frame section, may facilitate a more secure engagement of each frame section, as seen by the embodiments of FIG. 2 and FIG. 7A-7B respectively.

Figure 8B:
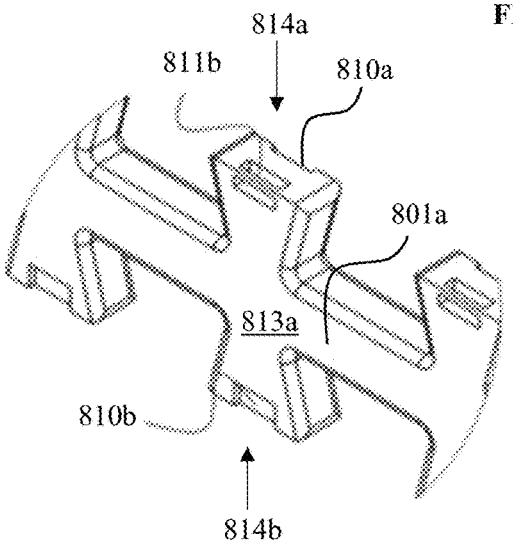
FIG. 8B-8C illustrate the front perspective and back perspective views, respectively, a second embodiment of a center frame section, according to an aspect.
Figure 8C:
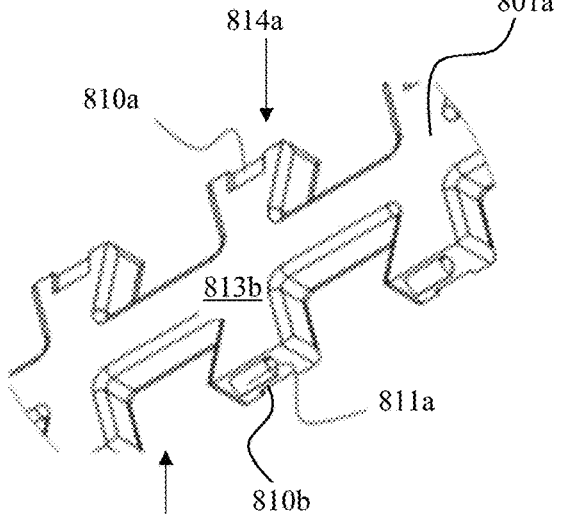

FIG. 8B-8C illustrate the front perspective and back perspective views, respectively, a second embodiment of a center frame section 801, according to an aspect. In order to facilitate the usage of the prior disclosed hook system and hinge to adjoin the frame sections together, it may be necessary to position the complementary structures on each frame section in a particular way. FIG. 8B shows a perspective from a "front" side 813*a* of the center frame sections, while FIG. 8C shows a perspective from the a "back" side 813*b* of the center frame section. In order for the center frame sections having this configuration to be suitably adjoined, it may be necessary to have the front side 813*a* of one center frame section on the same side of the frame as the back side 813*b* of each adjacent center frame section. This arrangement will allow for each first hinge pocket 810*a* on each center frame section to be aligned with a second hinge pocket 810*b* from another center frame section, thus allowing a hinge to be inserted into the two adjacent hinge pockets 810*a*, 810*b*, thus facilitating the rotational attachment between two adjacent center frame section. The hinge pockets 810*a*, 810*b* may be "diagonally disposed" to each other, such that the first hinge pocket 810*a* is at a top end 814*a* of the back side 813*b* of the center frame section 801*a*, while the second hinge pocket 810*b* is at a bottom end 814*b* of the front side 813*a* of the center frame section 801*a*.

The hook 811*a* and loop 811*b* of the hook system may be split between adjacent, adjoining center frame sections 801*a*, such that the hook 811*a* from a first center frame section is configured to engage with a loop 811*b* from a second center frame section. In order to facilitate this engagement of the hook 811*a* and loop 811*b* alongside the hereinabove disclosed alignment of the first and second hinge pocket 810*a*, 810*b*, the hook 811*a* and loop 811*b* provided on a singular center frame section 801*a* may also be "diagonally disposed" to each other. This in turn would result in the hook 811*a* being disposed on the bottom end 814*b* of the back side 813*b* of the center frame section 801*a*, while the loop is disposed on the top end 814*a* of the front side 813*a* of the center frame section 801*a*. With such an arrangement of hooks 811*a*, loops 811*b* and hinge pockets 810*a*, 810*b*, it is possible to use the same structure for each center frame section 801*a* of a frame, while allowing the frame to be collapsed into an accordion style stack while keeping it as single piece, as seen by accordion style stack 717 of FIG. 7B. It should be understood that each end frame section may have a hinge pocket 810*a*, 810*b* and a complementary hook 811*a* or loop 811*b* configured to engage with the adjacent loop 811*b* or hook 811*a*, respectively, as seen in FIG. 8A. The diagonal dispositions between each hinge pockets 810*a*, 810*b* and the diagonal disposition between the complementary hooks 811*a* and loops 811*b* may result in the hinges 810 being positioned or otherwise disposed on alternating sides of the frame between adjacent frame sections, as seen in FIG. 7A-7B.

For example, in FIG. 8A, the upper end frame section 801*b*-1 may be described as a "first frame section", whereas the center body section 801*a* may be described as a "second frame section". It may be stated that each hinge, such as hinge 710 of FIG. 7A, is configured to attach a first frame section to a second frame section to allow selective rotation of second frame section about the first frame section. Furthermore, each hook 811*a* may be associated with a corresponding first frame section and each loop 811*b* may be associated with a corresponding second frame section, such that the hook 811*a* is configured to selectively engage with the corresponding loop 811*b* to prevent the rotation of the corresponding second frame section. These engagement methods allow the frame sections of a frame to remain attached at all times due to the hinge, while allowing them to further engage with each other using the hooks 811*a* and loops 811*b* to form the planar wall frame 701 seen in FIG. 7A. This configuration of wall frame that uses hinges, hooks and loops may be preferred to the prior disclosed rod-based engagement method of FIG. 2, due to the ease, speed and convenience with which the prior may be assembled and the lack of loose parts needed to secure the frame into the planar configuration.

Figure 9A:
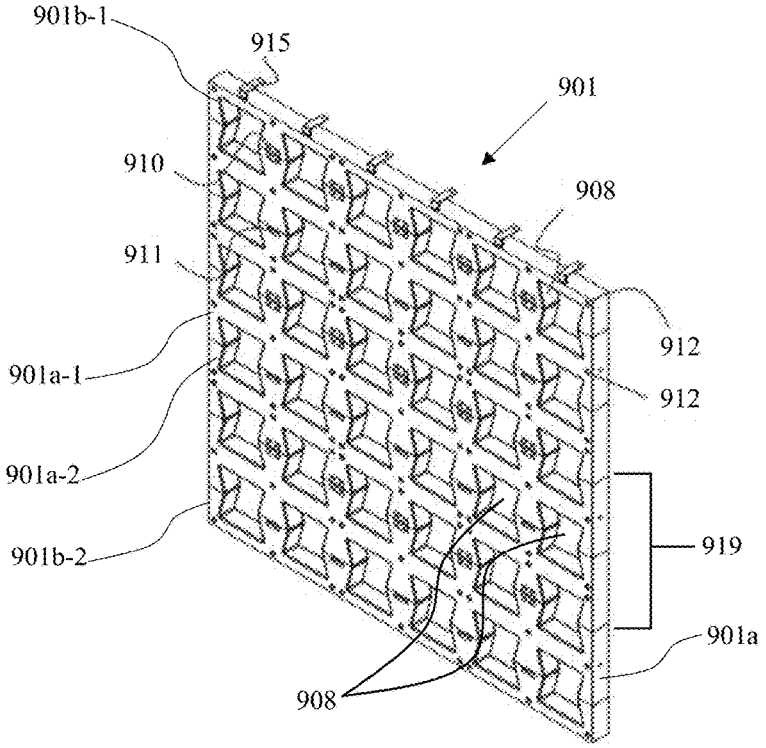
FIG. 9A illustrates the perspective view of a frame having a plurality of mounting hooks, according to an aspect.
Figure 9B:
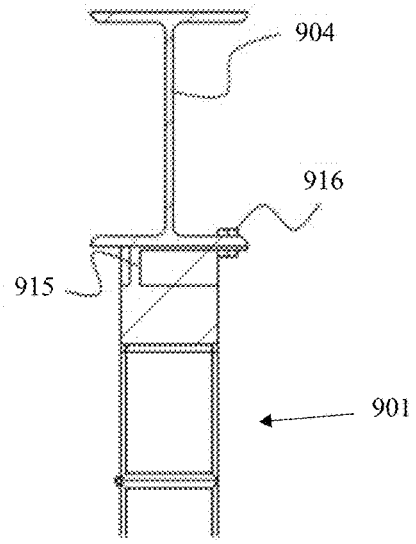
FIG. 9B illustrates the perspective side view of a frame attached to a support mount, according to an aspect.

FIG. 9A illustrates the perspective view of a frame 901 having a plurality of mounting hooks 915, according to an aspect. FIG. 9B illustrates the perspective side view of a frame 901 attached to a support mount 904, according to an aspect. In order to facilitate the engagement of the frame 901, and thus the formed fast built assembled wall, with a support mount 904, it may be necessary to provide a connective intermediary between the two elements. As can be seen in FIG. 9A, a plurality of mounting hooks 915 may be attached to a top of the frame 901, potentially directly to the end frame section 901*b* disposed at the top of the frame 901. A mounting bolt 916 may be used to attach each mounting hook 915 to the support mount 904, thus securing the frame 901 to said support mount 904. By securing the frame 901 to this support mount 904 and a base skirt, such as base skirt 103 of FIG. 1, the frame 901 may provide a suitably sturdy, mounted structure configured to engage with panel covers, thus allowing the built wall to be sturdy and capable of providing heat and sound insulation while providing a desired visual aesthetic.

As disclosed previously, certain embodiments of the cover panels may utilize securing rivets, such as cover panel 302 of FIG. 302 having securing rivets 302*a*, in order to facilitate a more secure connection between the cover panel and the frame 901. Frame 901 may have a plurality of rivet slots 912 nested within each frame section 901*a*, 901*b*, each of which is configured to securely engage with a corresponding securing rivet from a cover panel. This securing engagement helps the tenons of each cover panel to remain engaged with the corresponding mortises of the frame, while also further securing each frame section 901*a*, 901*b* it engages with directly together, and minimizing the separation between each cover panel and the frame 901. The quantity and placement of each rivet slot 912 may be complementary to the quantity and placement of each securing rivet from the cover panels, to ensure a secure engagement between the cover panels and the frame 901. As described hereinabove, the upper end frame section 901*b*-1 may be configured to engage with support mount 904, whereas the lower end frame section 901*b*-2 may be configured to engage with a base skirt.

As described hereinabove, a plurality of mortises 909 may be formed between adjacent frame sections 919. These adjacent frame sections may be described as pair of adjacent frame sections, wherein said pair of adjacent frame sections includes a first center frame section 901*a*-1 and a second center frame section 901*a*-2 disposed immediately below the first center frame section 901*a*-1. Adjacent frame sections 919 may alternatively include an end frame section and the center frame sections disposed closest to them, as described hereinabove in FIG. 1. Any two frame sections that are arranged to form at least one mortise 908 between them may be identified as adjacent frame sections and be identified as a pair of adjacent frame sections. Each component of a frame fastener may be made of a suitably durable and strong material, such as metal, wood and/or hard plastics.

Figure 10:
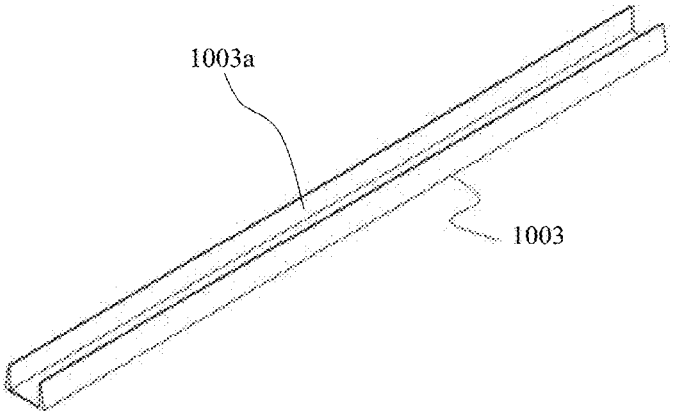
FIG. 10 illustrates the base skirt of the fast built assembled wall, according to an aspect.

FIG. 10 illustrates the base skirt of the fast built assembled wall, according to an aspect. While the prior disclosed support mount of FIG. 9 may be used to support the top part of a frame, the bottom portion of a frame may be supported by a structure such as a base skirt 1003. A base slot 1003*a* of the base skirt 1003 may surround the end frame section disposed at the bottom of a frame, as seen in FIG. 1 wherein the lower end frame section 102 is nested within the base skirt 103. The base slot 1003*a* of the base skirt 1003 may also surround a lower portion of the cover panels engaged with the lower end frame section, to maintain a uniform and clean design aesthetic. The base skirt 1003 and the prior disclosed support mount may work in conjunction with each other to secure and stabilize the disclosed frame and cover panels, and thus the fast built assembled wall as a whole.

The disclosed fast built assembled wall may provide a room dividing/partitioning solution that allows for rapid assembly of a modular, customizable wall capable of providing both heat and sound insulation. This modularity of the wall simplifies both its manufacturing and assembly. Certain embodiments of the fast build assembled wall may also be partially preassembled, allow to wall to be deployed by simply unfolding it into a planar configuration, as seen in FIGS. 7A-7B, while still be small enough to be easily packaged and transported as necessary. As a result of some dividing walls within a structure not needing to be load bearing, the disclosed fast built assembled wall may be supported by a beam above it and a base skirt below it to ensure it remains suitably positioned and supported after installation.

It may be advantageous to set forth definitions of certain words and phrases used in this patent document. The term "couple" and its derivatives refer to any direct or indirect communication between two or more elements, whether or not those elements are in physical contact with one another. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Further, as used in this application, "plurality" means two or more. A "set" of items may include one or more of such items. Whether in the written description or the claims, the terms "comprising," "including," "carrying," "having," "containing," "involving," and the like are to be understood to be open-ended, i.e., to mean including but not limited to. Only the transitional phrases "consisting of" and "consisting essentially of," respectively, are closed or semi-closed transitional phrases with respect to claims.

If present, use of ordinal terms such as "first," "second," "third," etc., in the claims to modify a claim element does not by itself connote any priority, precedence or order of one claim element over another or the temporal order in which acts of a method are performed. These terms are used merely as labels to distinguish one claim element having a certain name from another element having a same name (but for use of the ordinal term) to distinguish the claim elements. As used in this application, "and/or" means that the listed items are alternatives, but the alternatives also include any combination of the listed items.

The term "adjacent frame sections" may be used to describe a first and second frame section that are disposed next to each other such that an upper mortise section from a first frame section may be aligned with a lower mortise section from a second frame section to form a mortise.

Throughout this description, the aspects, embodiments or examples shown should be considered as exemplars, rather than limitations on the apparatus or procedures disclosed or claimed. Although some of the examples may involve specific combinations of method acts or system elements, it should be understood that those acts and those elements may be combined in other ways to accomplish the same objectives.

Acts, elements and features discussed only in connection with one aspect, embodiment or example are not intended to be excluded from a similar role(s) in other aspects, embodiments or examples.

Aspects, embodiments or examples of the invention may be described as processes, which are usually depicted using a flowchart, a flow diagram, a structure diagram, or a block diagram. Although a flowchart may depict the operations as a sequential process, many of the operations can be performed in parallel or concurrently. In addition, the order of the operations may be re-arranged. With regard to flowcharts, it should be understood that additional and fewer steps may be taken, and the steps as shown may be combined or further refined to achieve the described methods.

If means-plus-function limitations are recited in the claims, the means are not intended to be limited to the means disclosed in this application for performing the recited function, but are intended to cover in scope any equivalent means, known now or later developed, for performing the recited function.

Claim limitations should be construed as means-plus-function limitations only if the claim recites the term "means" in association with a recited function.

If any presented, the claims directed to a method and/or process should not be limited to the performance of their steps in the order written, and one skilled in the art can readily appreciate that the sequences may be varied and still remain within the spirit and scope of the present invention.

Although aspects, embodiments and/or examples have been illustrated and described herein, someone of ordinary skills in the art will easily detect alternate of the same and/or equivalent variations, which may be capable of achieving the same results, and which may be substituted for the aspects, embodiments and/or examples illustrated and described herein, without departing from the scope of the invention. Therefore, the scope of this application is intended to cover such alternate aspects, embodiments and/or examples. Hence, the scope of the invention is defined by the accompanying claims and their equivalents. Further, each and every claim is incorporated as further disclosure into the specification.

What is claimed is:

1. A modular wall comprising:

a frame having:

a plurality of frame sections comprising:

an upper end frame section having a plurality of upper mortise sections;

a lower end frame section having a plurality of lower mortise sections; and a plurality of center frame sections disposed between the upper end frame section and the lower end frame section, each center frame section having a plurality of upper mortise sections and a plurality of lower mortise sections;

a frame fastener configured to interconnect each frame section, such that a plurality of upper mortise sections from a first frame section of a pair of adjacent frame sections is configured to align with a plurality of lower mortise sections from a second frame section of the pair of adjacent frame sections to selectively form a plurality of mortises between the first frame section and the second frame section; and a plurality of cover panels, each cover panel having:

at least one tenon configured to snuggly engage with a corresponding mortise of the plurality of mortises, thus securing the cover panel to the frame, each tenon having a wide upper portion configured to engage with a corresponding upper mortise section, a wide lower portion configured to engage with a corresponding lower mortise section and a narrow middle portion disposed between and associated with the wide lower portion and wide upper portion, wherein each mortise has a shape complementary to that of the tenon, wherein upon engagement of a tenon with the corresponding mortise, the upper mortise section and the lower mortise section of each mortise wrap around the corresponding portion of each corresponding tenon such that the tenon prevents vertical and rotational movement of the frame sections that form the corresponding mortise.

2. The modular wall of claim 1, wherein each center frame section is centrosymmetric.

3. The modular wall of claim 1, wherein each mortise and each tenon has a double trapezoid shape.

4. The modular wall of claim 3, wherein each tenon is hollow and configured to be filled with an insulative material.

5. A modular wall comprising:

a frame having a plurality of frame sections;

a frame fastener configured to interconnect the plurality of frame sections to selectively form a plurality of mortises between adjacent frame sections of the plurality of frame sections, each of the plurality of mortises having upper mortise section and a lower mortise section; a plurality of cover panels, each cover panel having at least one double trapezoid shaped tenon configured to snuggly engage with a corresponding mortise of the plurality of mortises to selectively secure the cover panel to the frame, wherein the double trapezoid shaped tenon comprises a narrow middle portion disposed between and associated with a wide upper portion and a wide lower portion; wherein the upper mortise section and the lower mortise section of each mortise are configured to wrap around each tenon such that the tenon prevents vertical and rotational movement of the frame sections that form the corresponding mortise; and a plurality of cover panels, each cover panel having at least one double trapezoid shaped tenon configured to snuggly engage with a corresponding mortise of the plurality of mortises to selectively secure the cover panel to the frame to prevent vertical and rotational movement of adjacent frame sections, wherein the double trapezoid shaped tenon comprises a narrow middle portion disposed between and associated with a wide upper portion and a wide lower portion;

wherein the frame is configured to engage with a support mount and a base skirt in order to secure the modular wall.

6. The modular wall of claim 5 wherein each tenon is configured to be selectively removed from the corresponding cover panel.

7. The modular wall of claim 5, wherein each tenon is configured to be filled with an insulative material.

8. The modular wall of claim 5, wherein the frame is configured to be folded into an accordion style stack by the frame fastener through the utilization of hinges disposed between and associated with adjacent frame sections.

* * * * *